US011542649B2

(12) United States Patent
Koo

(10) Patent No.: US 11,542,649 B2
(45) Date of Patent: Jan. 3, 2023

(54) LAUNDRY TREATMENT DEVICE AND CONTROL METHOD THEREOF

(71) Applicant: LG ELECTRONICS INC., Seoul (KR)

(72) Inventor: Jain Koo, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 51 days.

(21) Appl. No.: 16/984,861

(22) Filed: Aug. 4, 2020

(65) Prior Publication Data

US 2021/0095409 A1 Apr. 1, 2021

(30) Foreign Application Priority Data

Sep. 26, 2019 (KR) ..... 10-2019-0119101

(51) Int. Cl.

| | |
|---|---|
| ***D06F 33/47*** | (2020.01) |
| ***D06F 34/05*** | (2020.01) |
| ***D06F 34/28*** | (2020.01) |
| ***D06F 34/14*** | (2020.01) |
| ***D06F 103/28*** | (2020.01) |

(Continued)

(52) U.S. Cl.

CPC ..... *D06F 33/47* (2020.02); *D06F 23/02* (2013.01); *D06F 34/05* (2020.02); *D06F 34/14* (2020.02); *D06F 34/28* (2020.02); *D06F 2101/20* (2020.02); *D06F 2103/28* (2020.02); *D06F 2105/44* (2020.02); *D06F 2105/54* (2020.02); *D06F 2105/58* (2020.02)

(58) Field of Classification Search

CPC ..... D06F 34/14; D06F 34/28; D06F 2103/28; D06F 2103/34

See application file for complete search history.

(56) References Cited

U.S. PATENT DOCUMENTS

2018/0080164 A1* 3/2018 Hoppe ..... D06F 34/28
2018/0266034 A1* 9/2018 Kamiyama ..... D06F 37/42

(Continued)

FOREIGN PATENT DOCUMENTS

| | | |
|---|---|---|
| CN | 209292723 | 8/2019 |
| EP | 2 048 274 | 4/2009 |

(Continued)

OTHER PUBLICATIONS

KR20080011507A Machine Translation (Year: 2008).*
European Search Report dated Nov. 25, 2020 issued in EP Application No. 20186750.4.

*Primary Examiner* — Spencer E. Bell
(74) *Attorney, Agent, or Firm* — Ked & Associates, LLP

(57) ABSTRACT

Disclosed are a washing machine and a control method thereof, capable of preventing occurrence of an accident related to a child or a pet being inside a washing tub. A washing machine according to an aspect of the present disclosure includes a concentration sensing part configured to a sense a concentration of a specific component in air measured inside or outside the washing tub, a controller configured to switch the door and the washing tub to a safe mode based on the concentration of the specific component sensed by the concentration sensing part, and a release signal detector configured to detect a release signal for switching the door and the washing tub, which have been switched to the safe mode by the controller, back to a normal mode.

8 Claims, 7 Drawing Sheets

(51) Int. Cl.

| | |
|---|---|
| ***D06F 105/44*** | (2020.01) |
| ***D06F 105/58*** | (2020.01) |
| ***D06F 101/20*** | (2020.01) |
| ***D06F 105/54*** | (2020.01) |
| ***D06F 23/02*** | (2006.01) |

(56) References Cited

U.S. PATENT DOCUMENTS

| | | | | |
|---|---|---|---|---|
| 2020/0087846 | A1* | 3/2020 | Park | G08B 21/22 |
| 2020/0253456 | A1* | 8/2020 | Heckes | G06F 8/38 |

FOREIGN PATENT DOCUMENTS

| | | | |
|---|---|---|---|
| EP | 3 502 338 | | 6/2019 |
| KR | 10-0603981 | | 7/2006 |
| KR | 20080011507 | A * | 2/2008 |
| KR | 10-1622597 | | 5/2016 |
| WO | WO 2020/055194 | | 3/2020 |

* cited by examiner

LAUNDRY TREATMENT DEVICE AND CONTROL METHOD THEREOF

CROSS-REFERENCE TO RELATED APPLICATION

This application claims priority under 35 U.S.C. § 119 to Korean Application No. 10-2019-0119101 filed on Sep. 26, 2019, whose entire disclosure is hereby incorporated by reference.

BACKGROUND

1. Field

The present disclosure relates to a washing machine and a control method thereof. More particularly, the present disclosure relates to a washing machine capable of preventing occurrence of an accident related to a child or a pet being inside a washing tub, and a control method thereof.

2. Background

In general, a washing machine is a machine that washes laundry by using an emulsifying effect of detergent, a frictional force of a water stream made by rotation of a washing blade, and an impact applied by the washing blade. Such washing machines mainly use an electric motor as a main power source, and as the washing, rinsing, and dehydration processes are performed using the action of detergent and water, contaminants in clothing are separated from the clothing.

Washing machines are divided into a cylinder type, an agitator type, and a pulsator type depending on the washing method. While the detailed structure of these types of washing machine may differ in diverse ways according to their respective functions, each include in common a washing tub into which laundry is inserted and in which washing, rinsing, and spin-drying processes are performed, and a door for opening and closing a laundry entrance formed in one surface of the washing tub.

Due to the structure of such washing machines, if a child or a pet enters the washing tub while the laundry entrance is open, and the door is then closed, it may be difficult for the child or pet to open the door by themselves. Accordingly, accidents due to a lack of oxygen in the washing tub or due to operation of the washing machine may occur. For this reason, in order to prevent such accidents from occurring, it is desirable to prevent in advance children or pets from entering the washing tub in the first place, or to induce an immediate reaction from a child or pet that has entered the washing tub.

Further, since such accidents have the potential to lead to serious injury and even death, the safety of the child or pet must first and foremost be ensured in cases where there is a concern that such an accident may occur, even if it means restricting the operation of the washing machine. Such restriction of the operation of the washing should then only be released once the safety of the child or pet has been confirmed.

However, if the operation of the washing machine is restricted based simply on a concern that an accident may occur, even when it is not established that there is a child or pet in the washing tub, the user may frequently be inconvenienced by not being able to operate the washing machine as he or she intends. Accordingly, there is a need for a process to allow the operation of the washing machine to be initially restricted when there is a concern of such an accident occurring and then to allow the restriction to be released based on reliable grounds, while also allowing such a process to take place easily from the perspective of the user.

In addition, depending on the behavior patterns of the child or the pet, various different situations may occur when the child or the pet has entered the washing tub. For example, the child or pet may actively move around inside the washing tub, or by contrast the child or pet may simply be present in the washing tub without making any sounds or movements.

As such, when the child or pet is actively moving around inside the tub, the presence of the child or pet can easily be detected by means of various sensors. However, when the child or pet is simply present in the washing tub without making any sounds or movements, such detection may be difficult. Accordingly, when detecting the presence of a child or pet in the washing tub, rather than simply relying on passively obtained information for such detection, it is further desirable to take proactive steps therefor in cases where it may be difficult to detect the child or pet in the washing tub.

Regarding such accidents in a washing machine as described above, in Korean Patent Registration No. 10-0603981 (hereinafter, referred to as "related art 1"), disclosed is a method and apparatus for a child lock of a drum washing machine. In detail, related art 1 discloses a feature in which, by interrupting an operation mode signal inputted to a key input unit of a drum washing machine and an on/off switching signal of a power switching unit, unintended operation of the drum washing machine caused by indiscriminate operation by a child can be prevented, and the child can accordingly be protected from the risk of accident related to such unintended operation.

However, the drum washing machine in related art 1 has no relation to accidents occurring due to a child entering the washing machine, and is thus unable to prevent such accidents in advance. Furthermore, although a feature of executing the child lock of the drum washing machine in order to prevent accidents is disclosed, there is no specific consideration in related art 1 regarding releasing of the child lock.

Further, Korean Patent Registration No. 10-1622597 (hereinafter, referred to as "related art 2") discloses a method for indicating an accident in a drum washing machine and a washing machine implementing the method. In detail, related art 2 discloses a feature in which, in case of a child or pet being trapped inside a washing tub by a door thereof closing, movement of an object inside the drum can be detected by means of a vibration sensor and notification thereof can be externally outputted as a message by means of a buzzer or speaker, thereby preventing accidents from occurring.

However, the washing machine of related art 2 is limited to detecting when a child or pet is trapped inside the washing tub and externally outputting notification thereof, and discloses no feature related to preventing children or pets from becoming trapped in the washing tub in advance. Furthermore, the washing machine of related art 2 is only able to detect the presence of an object in the drum when the object moves in the drum, and is thus unable to detect a child or pet in the drum when the child or pet is simply present in the drum without making any sounds or movements. As such, although directed to preventing occurrence of accidents related to a child or pet being inside the washing tub, the washing machines of the related art are unable to appropriately do so.

The above references are incorporated by reference herein where appropriate for appropriate teachings of additional or alternative details, features and/or technical background.

BRIEF DESCRIPTION OF THE DRAWINGS

The embodiments will be described in detail with reference to the following drawings in which like reference numerals refer to like elements wherein.

DETAILED DESCRIPTION

Figure 1:
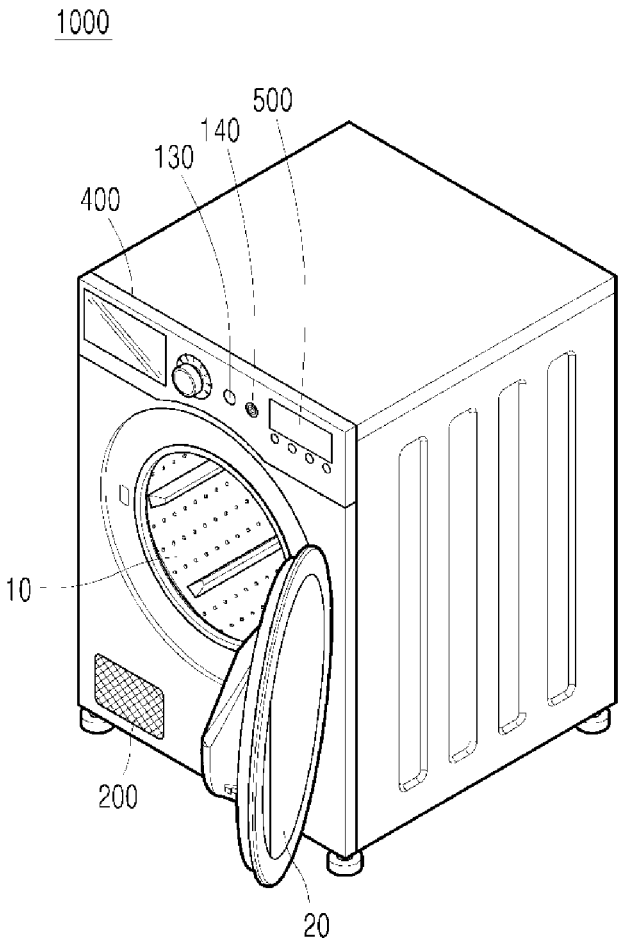
FIG. 1 is a perspective view of an example of a washing machine according to an embodiment of the present disclosure.

As depicted in FIGS. 1-4, a washing machine 1000 according to an embodiment of the present disclosure includes a washing tub 10 which is opened and closed by a door 20 in one surface thereof. The washing machine 1000 is capable of performing at least one of a wash cycle, a rinse cycle, a spin-dry cycle, or a dry cycle.

The washing tub 10 is a part in which laundry is received in a receiving space therein and the at least one of the wash cycle, the rinse cycle, the spin-dry cycle, or the dry cycle is performed, and includes a laundry entrance formed in one surface thereof through which laundry is inserted. The laundry entrance is configured to be opened and closed by the door 20, and may be sealed by the door 20 while the at least one of the wash cycle, the rinse cycle, the spin-dry cycle, or the dry cycle is being performed However, since the door 20 may be opened while the washing machine 1000 is in a standby state, there is a possibility of child or pet entering the washing tub 10 through the opened laundry entrance. In such a situation, if the door 20 is then closed, the door 20 may be automatically locked, and it may be difficult for the child or pet to exit the washing tub 10. Furthermore, even if the door 20 is not locked, the child or pet may have difficulty in opening the door by themselves, and thus accidents due to a lack of oxygen in the washing tub 10 or due to operation of the washing machine may occur.

In order to prepare for such a situation, as illustrated in FIGS. 1 to 5, the washing machine 1000 according to an embodiment of the present disclosure may include a concentration sensing part (or first sensor) 100, a controller 300, and a release signal detector (or second sensor) 400, and may further include a warning signal output interface (or warning output device) 200.

The concentration sensing part 100 is a part for sensing the concentration of a specific component in air measured inside or outside the washing tub 10, and identifies the possibility of an accident occurring in the washing tub 10 by sensing the distribution of a specific component of which the concentration may be changed by the presence of an object to be protected 30 in the washing tub 10. For example, when an object to be protected 30 is present in the washing tub 10, the concentration of a specific component (such as oxygen, carbon dioxide, and water vapor) in the air measured inside or outside the washing tub 10 may change due to the breathing of the object to be protected 30. Accordingly, a situation in which such a change in concentration of the specific component in the air is sensed by the concentration sensing part 100 is one in which an object to be protected 30 is present within a predetermined range of the washing tub 10, and such a situation is thus treated as involving the possibility of an accident occurring. The object to be protected 30 refers to an object with respect to which an accident may occur if the object enters the washing tub 10, such as a child or a pet.

Here, the concentration sensing part 100 may be installed both inside and outside the washing tub 10, so as to separately sense the concentration of the specific component in the air measured inside the washing tub 10 and the concentration of the specific component in the air measured outside the washing tub 10. That is, the concentration sensing part 100 may separately sense whether components in the air inside the washing tub 10 change and whether components in the air outside the washing tub 10 change, due to the presence of the object to be protected 30.

For example, if a change in concentration of the specific component in the air inside the washing tub 10 is sensed, this indicates that an object to be protected 30 is present in the washing tub 10, and thus immediate measures to ensure the safety of the object to be protected 30 should be taken. By contrast, if a change in concentration of the specific component in the air outside the washing tub 10 is sensed, this indicates that the object to be protected 30 is not yet present in the washing tub 10, and thus precautionary or phased measures to ensure the safety of the object to be protected 30 may be taken.

To this end, the concentration sensing part 100 may include internal sensors 110 and 120 for sensing the concentration of the specific component in the air measured inside the washing tub 10, and external sensors 130 and 140 for sensing the concentration of the specific component in the air measured outside the washing tub 10. For example, internal sensor (or first oxygen sensor) 110 and external sensor (or first external sensor) 130 may detect respective levels of a first compound (e.g., oxygen) inside and output the washing tub 10, and internal sensor (or second internal sensor) 120 and external sensor (or second external sensor) 140 may detect respective levels of a second compound (e.g., water vapor and/or carbon dioxide) inside and output the washing tub 10. By sensing the concentration of the specific component(s) both in the air inside the washing tub 10 and the air outside the washing tub 10 in this way, the washing machine 1000 according to this embodiment can identify the possibility of occurrence of accidents according to various different situations in a variety of different ways.

Figure 2:
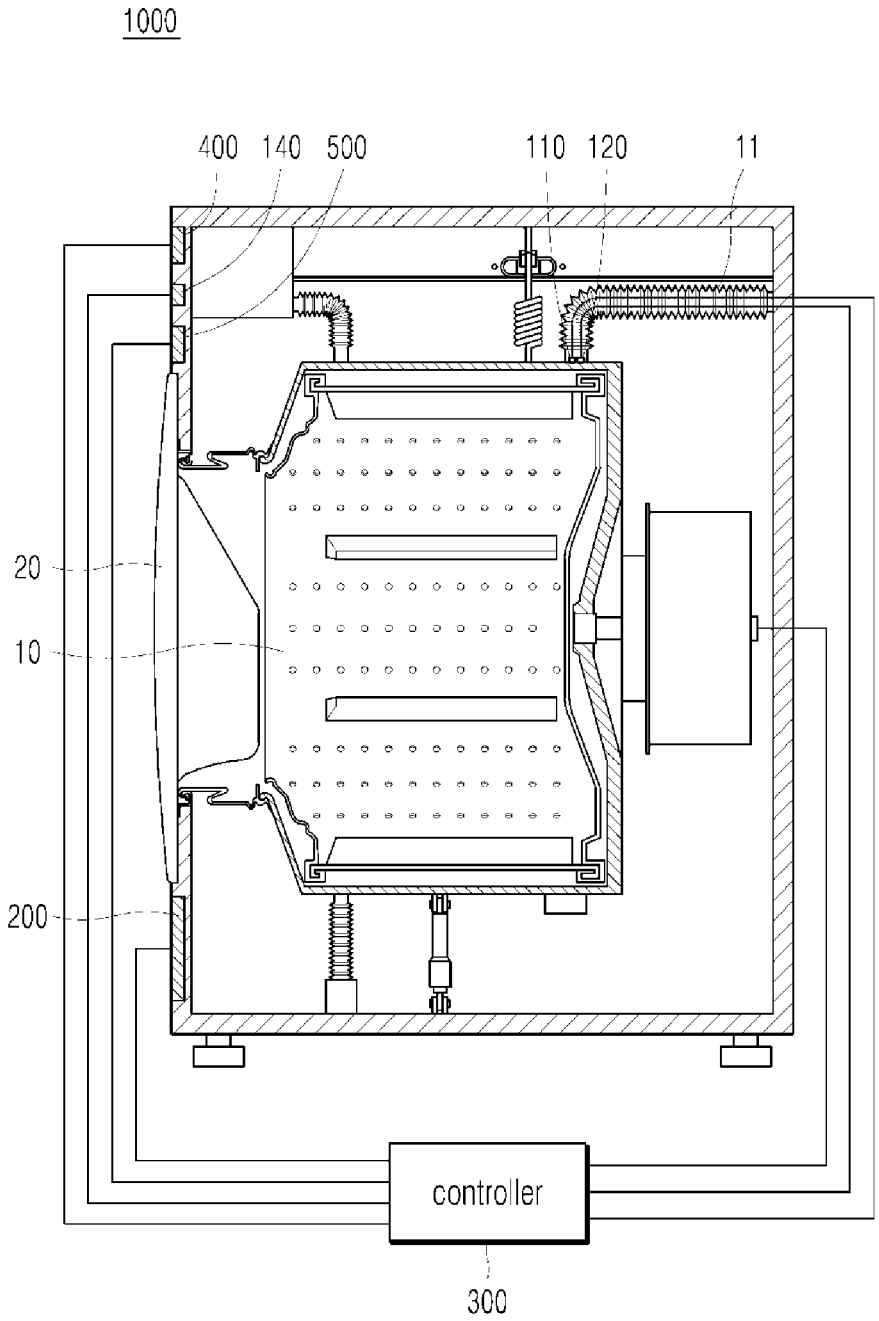
FIG. 2 is a diagram schematically illustrating the main components of the washing machine according to an embodiment of the present disclosure.
Figure 3:
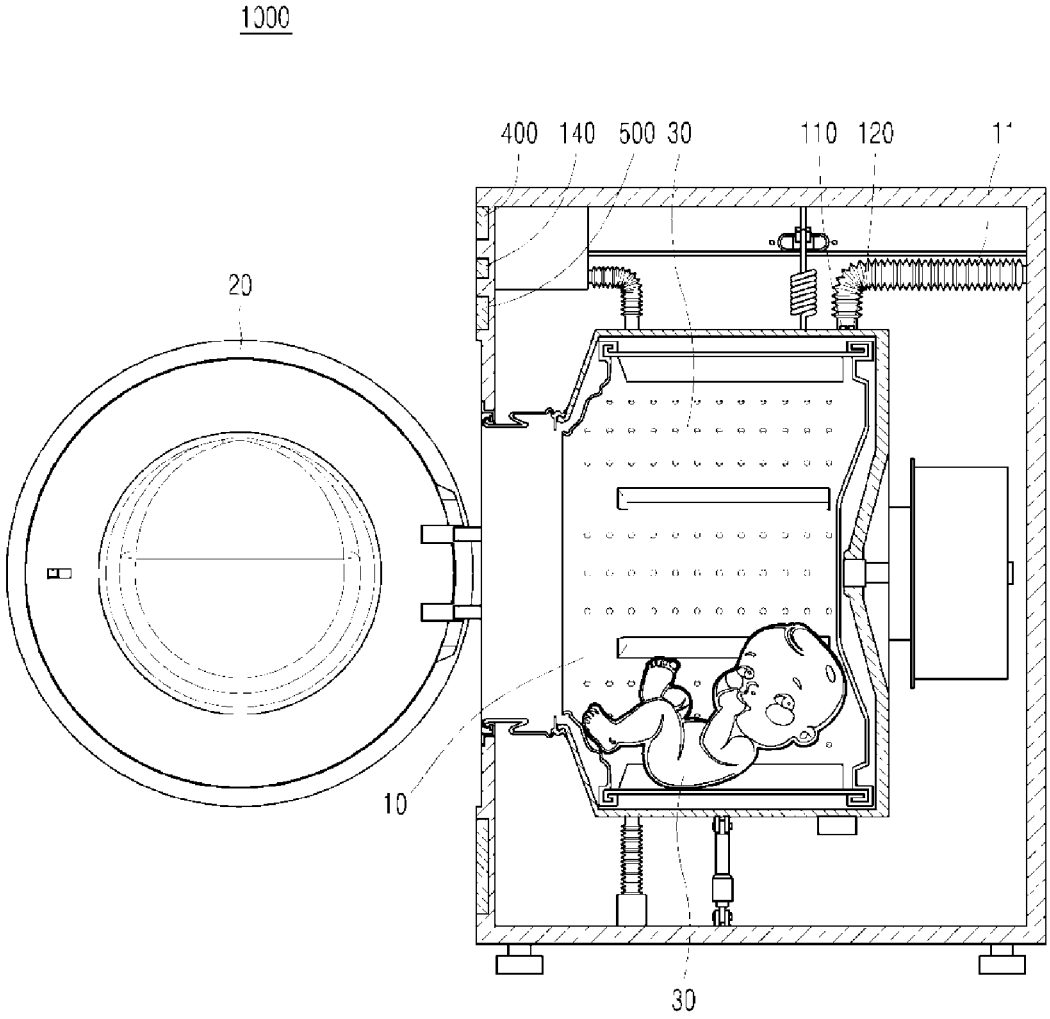
FIG. 3 is a diagram illustrating an example of a state in which the washing machine according to an embodiment of the present disclosure is switched to a safe mode.

Here, the washing tub 10 may include an air outlet 11 formed so as to communicate with the air outside the washing tub 10, and the internal sensors 110 and 120 may be installed in the air outlet 11. In detail, as illustrated in FIGS. 2 and 3, the air outlet 11 may be formed in the washing tub 10 such that the inside of the washing tub 10 communicates with the outside air. Such an air outlet 11 is a kind of safety vent pipe, which when necessary can communicate with the outside air so that the inside of the washing tub 10 is not completely sealed.

Specifically, the washing tub 10 may include an inner tub (or drum) that rotates while laundry is received therein, and an outer tub that covers the inner tub and fixes the inner tub to the washing machine 1000. Accordingly, the air outlet 11 may be formed in the fixed outer tub, such that communication between the washing tub 10 and the outside air can be stably achieved.

As a result, since the air flow in the washing tub 10 is highest at the air outlet 11 and there is no separate air flow at the air outlet 11, it can be said that the air outlet 11 is the most appropriate position for installation of the internal sensors 110 and 120. As such, in the washing machine 1000 according to this embodiment, since the concentration of the specific component in the air is sensed in the air outlet 11 that is formed in the washing tub 10 so as to communicate with the air outside the washing tub 10, the internal sensors 110 and 120 are installed at a position with good air flow and at which stable installation is possible, thereby improving sensing performance.

The warning signal output interface 200 is a part for outputting a warning signal based on the concentration of the specific component sensed by the concentration sensing part 100, and outputs the warning signal when there is a risk of an accident occurring. The warning signal is a signal for notifying users in the vicinity of the washing machine 1000 that there is a risk of accident, and may be implemented as a visual signal, an auditory signal, or a combined visual and auditory signal. For example, as illustrated in FIG. 1, the warning signal output interface 200 may include a speaker installed in the washing machine 1000, and may thereby output an auditory warning signal when necessary.

The controller 300 is a part for switching the door 20 and the washing tub 10 to a safe mode based on the concentration of the specific component sensed by the concentration sensing part 100, and restricts the operation of the washing machine 1000 when there is a possibility of an accident occurring. The safe mode refers to a predetermined state in which, when there is a risk of accident, the operation of the washing machine 1000 is restricted until it is confirmed that the risk has been removed, such that even when an object to be protected 30 is present in the washing tub 10 as illustrated in FIG. 3, no harm comes to the object to be protected 30.

The release signal detector 400 is a part for detecting a release signal for switching the door 20 and the washing tub 10, which have been switched to the safe mode by the controller 300, back to a normal mode. The release signal detector 400 identifies whether the risk of accident has been removed based on whether a predetermined release signal has been sensed. That is, in response to the release signal detector 400 detecting the predetermined release signal, the risk of accident is treated as having been removed.

Figure 4:
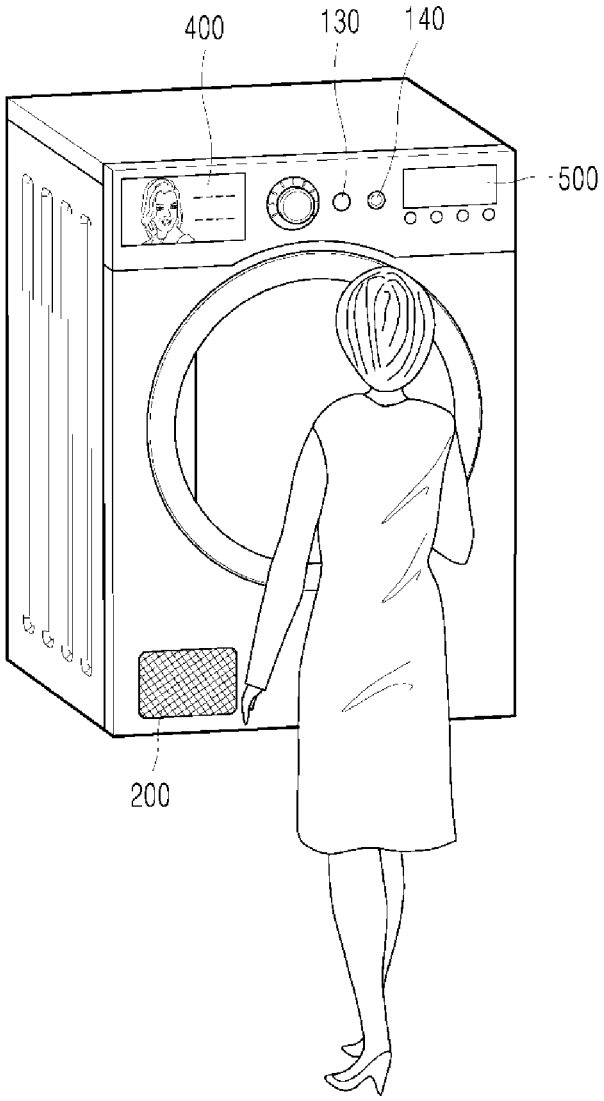
FIG. 4 is a block diagram illustrating an example of a release signal detector in the washing machine according to an embodiment of the present disclosure.

As a signal by which it can be established that the risk of accident has been confirmed to no longer exist, the release signal can only be inputted by a subject who has been registered in advance as a user authorized to operate the washing machine 1000. For example, as illustrated in FIG. 4, face information of a user authorized to operate the washing machine 1000 may be registered in advance as the release signal via a camera and screen installed in the washing tub 10. Accordingly, when the washing machine 1000 has been switched to the safe mode, the washing machine 1000 can be switched back to the normal mode in response to the release signal detector (e.g., a camera) 400 detecting the face of a registered user who has approached the washing machine 1000.

In addition, voice information of a user authorized to operate the washing machine 1000 may be registered in advance as the release signal via a microphone installed in the washing tub 10. Accordingly, when the washing machine 1000 has been switched to the safe mode, the washing machine 1000 can be switched back to the normal mode in response to the release signal detector (e.g., a microphone) 400 detecting the voice of a registered user who has approached the washing machine 1000.

In addition, even when no specific signal has been registered in advance as the release signal, a user authorized to operate the washing machine 1000 can be induced to speak a specific word via a query and response method, and the specific word can function as the release signal. Accordingly, when the washing machine 1000 has been switched to the safe mode, the washing machine 1000 can be switched back to the normal mode in response to the release signal detector 400 detecting an appropriate response to a specific question by a registered user who has approached the washing machine 1000.

As such, in cases such as those described above, a registered user who approaches the washing machine 1000 can confirm the presence or absence of the risk of accident in a natural manner. Accordingly, since detection of the release signal can be seen as a confirmation that there is no risk of accident, the washing machine 1000 can safely be switched back to the normal mode without the risk of an accident occurring.

Figure 5:
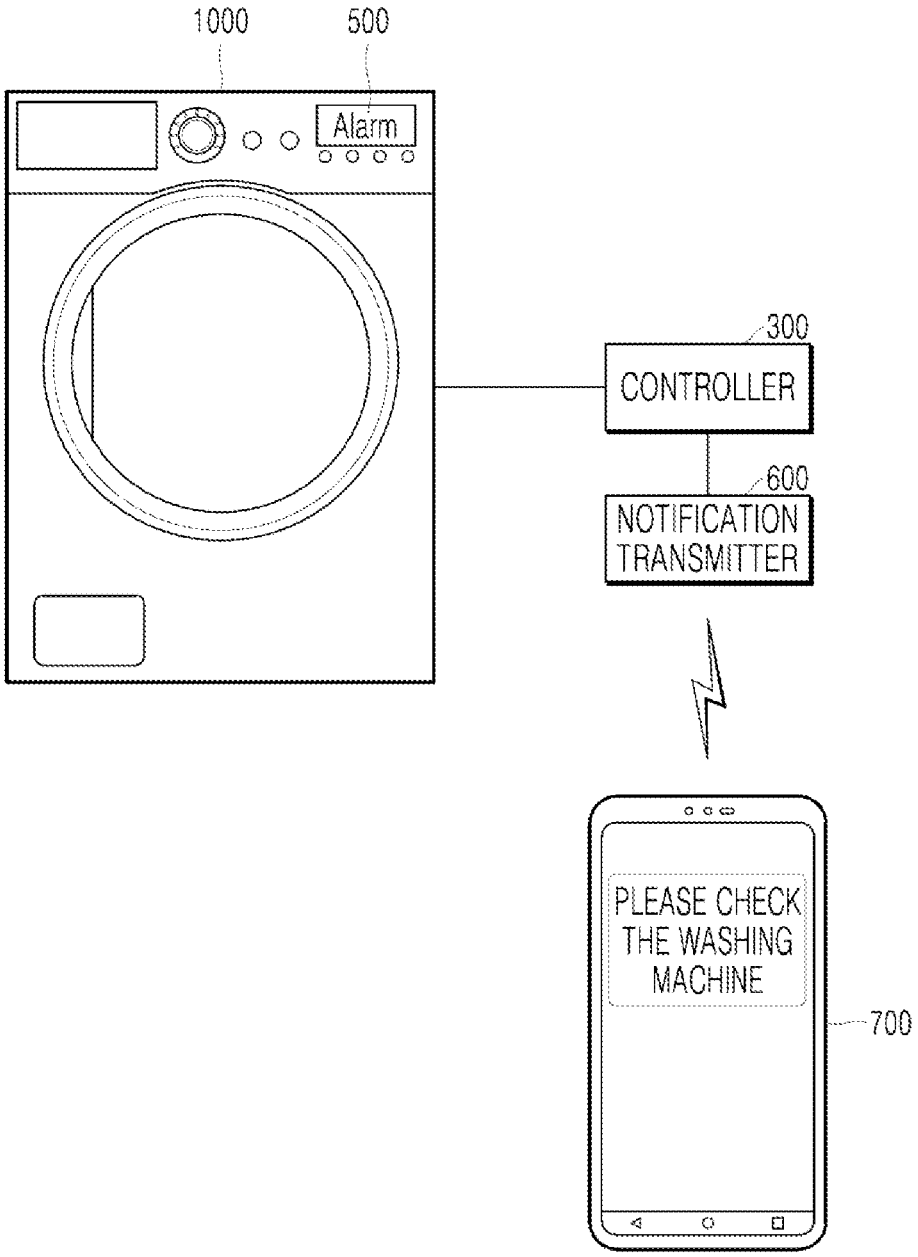
FIG. 5 is a diagram schematically illustrating an example of a notification output interface in the washing machine according to an embodiment of the present disclosure.

FIG. 5 is a diagram schematically illustrating an example of a notification output interface in the washing machine according to an embodiment of the present disclosure. As shown in FIG. 5, the washing machine 1000 according to an embodiment of the present disclosure may further include a notification output interface 500 (or notification output device) and a notification transmitter 600.

The notification output interface 500 is a part for outputting notification information according to the concentration of the specific component sensed by the concentration sensing part 100, by displaying the notification information. The notification output interface 500 may display notification information indicating whether, for example, the washing machine 1000 is in a normal state or whether there is a possibility of an accident requiring confirmation by a user, based on the sensed concentration.

Here, the notification information refers to a notification by which a user can be notified of information on the state of the washing machine 1000, and may be in the form of a visual signal, an auditory signal, or a combined visual and auditory signal. For example, as illustrated in FIG. 5, the notification output interface 500 may include a screen installed in the washing machine 1000, and may thereby output visual information when necessary.

The notification transmitter 600 is a part for remotely transmitting the notification information according to the concentration of the specific component sensed by the concentration sensing part 1000, and may transmit the notification information regarding the washing machine 1000 to a user at a distance from the washing machine 1000. For example, as illustrated in FIG. 5, the notification information may be remotely transmitted, via a separate notification transmitter 600 installed in the washing machine 1000, to a terminal 700 held by a user.

The transmitted notification information can then be outputted on the terminal 700 as a visual signal, an auditory signal, or a combined visual and auditory signal. In this way, the user may check the status of the washing machine and immediately approach the washing machine 1000 when follow-up measures are required to be taken.

Figure 6:
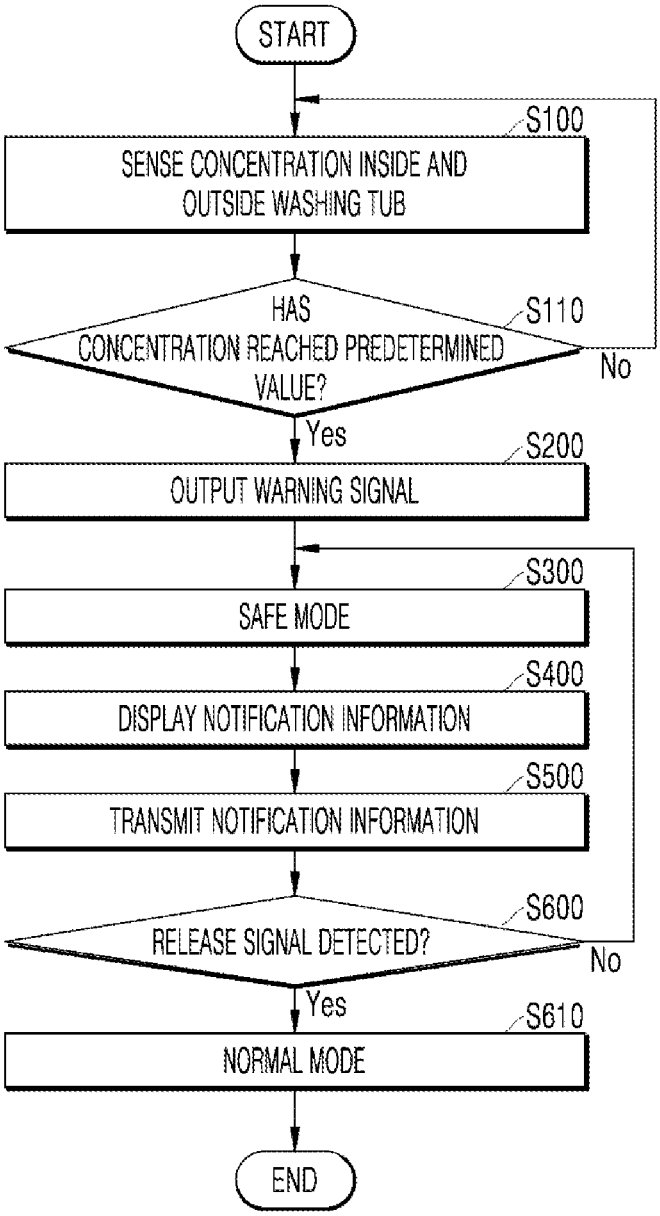
FIG. 6 is a flowchart illustrating a method for controlling a washing machine according to an embodiment of the present disclosure.

FIG. 6 is a flowchart illustrating a method for controlling a washing machine according to an embodiment of the present disclosure. Hereinbelow, the method for controlling a washing machine according to an embodiment of the present disclosure will be described with reference to FIG. 6. Since the method for controlling a washing machine according to this embodiment is implemented to include the main configuration of the above-described washing machine 1000, reference will also be made to FIGS. 1 to 5 in the following description.

Firstly, the concentration of a specific component in air measured inside or outside the washing tub 10 is sensed (step S100). That is, the specific component in the air measured inside or outside the washing tub 10 is sensed so as to identify a possibility of occurrence of an accident.

Here, in the method for controlling a washing machine according to this embodiment of the present disclosure, the concentration of the specific component in the air measured inside the washing tub 10 and the concentration of the specific component in the air measured outside the washing 10 tub may be sensed separately. That is, in step S100, the specific component in the air inside the washing tub 10 and the air outside the washing tub 10 is sensed through the internal sensors 110 and 120 and the external sensors 130 and 140 respectively installed inside the washing tub 10 and outside the washing tub 10.

In step 100, it can be sensed whether the concentration of the specific component in the air outside the washing tub 10 changes. If a change in concentration of the specific component in the air outside the washing tub 10 is sensed, this indicates that an object to be protected 30 is present within a predetermined range of the washing tub 10, and such a situation is thus treated as involving the possibility of an accident occurring.

Further, in step 100, it can be sensed whether the concentration of the specific component in the air inside the washing tub 10 changes. If a change in concentration of the specific component in the air inside the washing tub 10 is sensed, this indicates that an object to be protected 30 is present in the washing tub 10, and thus immediate measures to ensure the safety of the object to be protected 30 should be taken.

Here, it may be sensed whether at least one of the concentration of the specific component sensed inside the washing tub 10 or the concentration of the specific component sensed outside the washing tub 10 has reached a predetermined value (step S110). The predetermined value refers to a concentration of the specific component of an extent to which it may be deemed that an object to be protected 30 is present in the washing tub 10 and thus that there is a high possibility of an accident occurring. The predetermined value may be set in advance based on statistics or may be set by the user in the washing machine 1000 at his or her discretion. If the sensed concentration has not reached the predetermined value, the situation may be treated as one in which there is no concern related to an object to be protected 30 approaching the washing machine 1000.

By contrast, if the sensed concentration has reached the predetermined value, a warning signal is outputted (step S200). That is, the warning signal is outputted in response to a determination that there is a possibility of an accident occurring based on the sensing of the concentration of the specific component in the air in the washing tub 10. Depending on the extent of the risk of accident, the warning signal may be selectively controlled to be on or off, or the strength of the warning signal may be controlled in stages.

Thereafter, if the sensed concentration has reached the predetermined value, the door 20 and the washing tub 10 are switched to the safe mode (step S300). That is, the operation of the washing machine 1000 is switched to the safe mode in response to a determination that there is a possibility of an accident occurring based on the sensing of the concentration of the specific component in the air in the washing tub 10.

Specifically, in the method for controlling a washing machine according to this embodiment, by switching the door 20 and the washing tub 10 to the safe mode in response to the concentration of the specific component sensed inside and/or outside the washing tub 10 reaching the predetermined value, the washing machine 1000 can be appropriately switched from the normal mode in which the washing machine 1000 can operate normally to the safe mode in which the operation of the machine 1000 is restricted.

Further, the safe mode is maintained until it is confirmed that the risk of accident has been removed, such that even when an object to be protected 30 is present in the washing tub 10, no harm comes to the object to be protected 30. As such, in the method for controlling a washing machine according to this embodiment, by outputting the warning signal and switching the door 20 and the washing tub 10 to the safe mode in response to a determination of a possibility of occurrence of an accident based on a sensed concentration of a specific component in the air measured inside or outside the washing tub 10, it is possible to effectively prevent the occurrence of an accident involving a child or pet being inside the washing tub 10.

Next, a release signal for switching the door 20 and the washing tub 10 that have been switched to the safe mode back to the normal mode is sensed (step S600). That is, based on whether a release signal set in advance is detected, it is identified whether the risk of accident has been removed.

Step 600 can be implemented via the face recognition, voice recognition, or query-response recognition processes described above, and since the detection of the release signal via such processes can be deemed as a confirmation by an authorized user that there is no risk of accident, the washing machine 1000 can safely be switched back to the normal mode without the risk of an accident occurring. Accordingly, in response to the release signal being detected in step S600, the door 20 and the washing tub 10 are automatically switched back to the normal mode (step S610).

As such, in the method for controlling a washing machine according to this embodiment, by switching the door 20 and the washing tub 10 back to the normal mode in response to a determination that there is no risk of accident based on detection of a release signal set in advance, the washing machine 1000 can return to normal functioning based on reliable grounds, while also allowing such a process to take place easily from the perspective of the user.

Further, in the method for controlling a washing machine according to this embodiment, by identifying the presence of a child or pet in the washing tub 10 based on the concentration of the specific component in the air measured inside or outside the washing tub 10 even when the child or pet does not make any sounds or movements, the presence of the child or pet in the washing tub 10 can be effectively detected even in situations in which such detection is difficult.

In the method for controlling a washing machine according to this embodiment, step S100 may be performed by sensing the concentration of at least one of oxygen or carbon dioxide. When the object to be protected 30 is present inside the washing tub 10, the concentration of oxygen may gradually decrease and the concentration of carbon dioxide may gradually increase.

In particular, when the concentration of oxygen decreases to below a certain level, or when the concentration of carbon dioxide increases to above a certain level, it can be said that there is a significant risk of suffocation or asphyxiation accidents involving the object to be protected 30 in the washing tub 10. Such accidents are significantly more fatal in comparison to other accidents.

It can therefore be said that detecting the concentration of oxygen or carbon dioxide is essential in order to properly prevent suffocation or asphyxiation accidents that may occur inside the washing tub 10. As such, in the method for controlling a washing machine according to this embodiment, by sensing the concentration of at least one of oxygen or carbon dioxide, appropriate measures can be provided to prevent the potential occurrence of suffocation or asphyxiation accidents involving a child or pet in the washing tub 10.

In the method for controlling a washing machine according to this embodiment, step S300 may include switching the door 20 to an unlock mode and switching the washing tub 10 to a lock mode. Here, the door 20 being in the unlock mode refers to a state in which the door 20 is not closed or locked. Accordingly, when the door 20 is in the unlock mode, an accident can be prevented even when an object to be protected 30 has entered the washing tub 10, since the door 20 remains opened.

In addition, the washing tub 10 being in the lock mode refers to a state in which operation of the washing tub 10 to perform at least one of a wash cycle, a rinse cycle, a spin-dry cycle, or a dry cycle is restricted. Accordingly, when the washing tub 10 is in the lock mode, an accident can be prevented even when an object to be protected 30 has entered the washing tub 10, since the washing tub 10 is unable to operate. As such, in the method for controlling a washing machine according to this embodiment, by switching the door 20 to the unlock mode and switching the washing tub 10 to the lock mode, accidents due to lack of oxygen or due to operation of the washing machine 1000 can be prevented even when a child or pet enters the washing tub 10.

The method for controlling a washing machine according to this embodiment may further include outputting notification information according to the sensed concentration of the specific component by displaying the notification information (step S400). That is, based on the sensed concentration, notification information indicating, for example, whether the washing machine 1000 is in a normal state or whether there is a possibility of an accident requiring confirmation by a user, may be displayed. As such, in the method for controlling a washing machine according to this embodiment, by outputting notification information according to the sensed concentration of the specific component by displaying the notification information, a user can easily identify the state of the washing machine 1000 in relation to a potential accident.

Furthermore, the method for controlling a washing machine according to this embodiment may further include remotely transmitting the notification information according to the sensed concentration of the specific component (step S500). That is, the notification information about the washing machine 1000 may be transmitted to a user at a remote location from the washing machine 1000, and the user can immediately approach the washing machine 1000 to take the required follow-up measures. As such, in the method for controlling a washing machine according to this embodiment, by remotely transmitting the notification information according to the sensed concentration of the specific component to a user, the user can easily identify the state of the washing machine 1000 relatively quickly and easily even when he or she is at a distance from the washing machine 1000.

Figure 7:
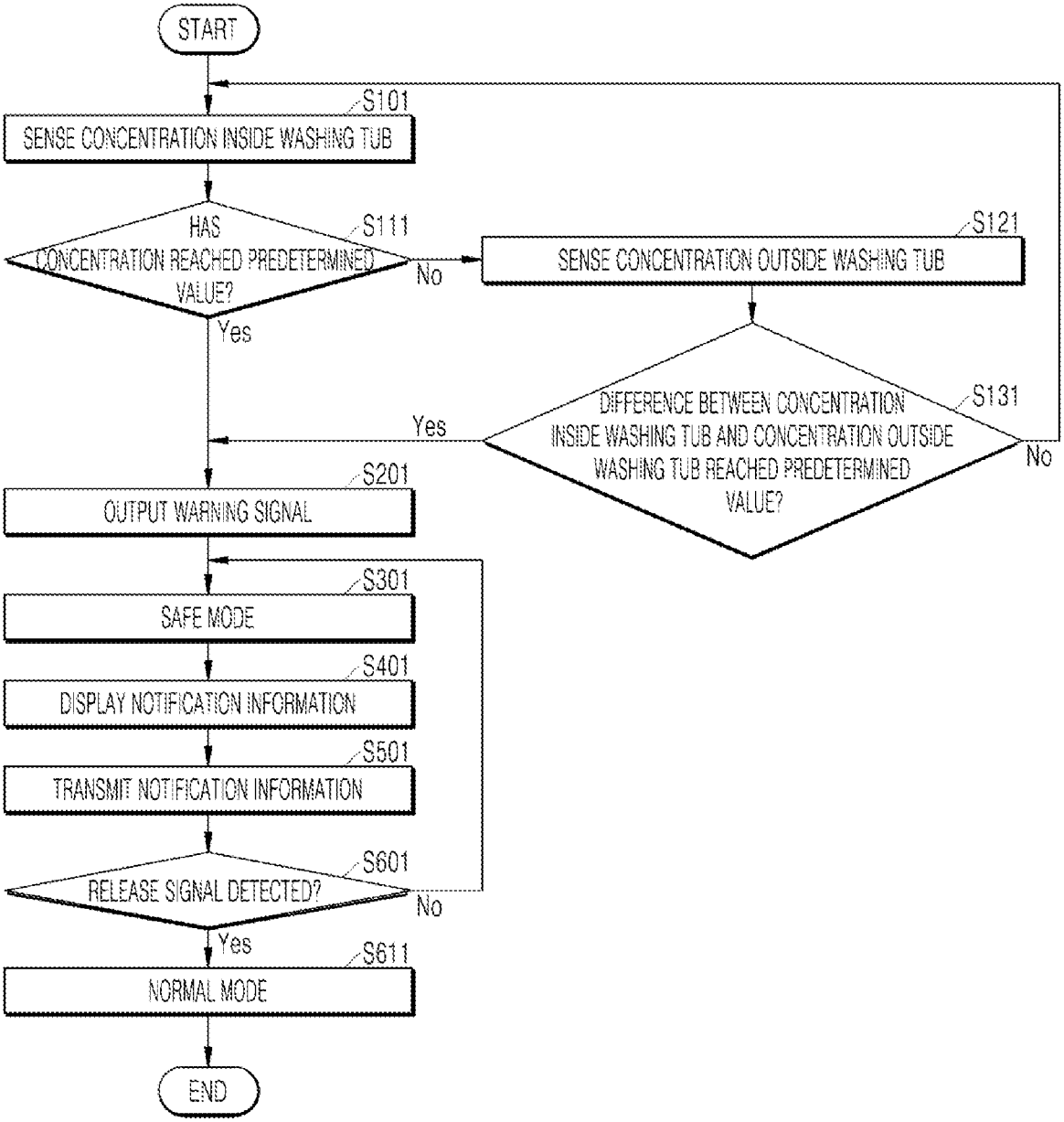
FIG. 7 is a flowchart illustrating a method for controlling a washing machine according to another embodiment of the present disclosure.

FIG. 7 is a flowchart illustrating a method for controlling a washing machine according to an embodiment of the present disclosure. Hereinbelow, the method for controlling a washing machine according to an embodiment of the present disclosure will be described with reference to FIG. 7. Firstly, the concentration of a specific component in air inside the washing tub 10 is sensed (step S101). That is, in step S101, the specific component in the air inside the washing tub 10 is sensed through the internal sensors 110 and 120 installed inside the washing tub 10.

Thereafter, it may be sensed whether the concentration of the specific component sensed inside the washing tub 10 has reached a predetermined value (step S111). If a change in concentration of the specific component in the air inside the washing tub 10 is sensed as described above, this indicates that immediate measures to ensure the safety of an object to be protected 30 should be taken. For this reason, it is preferable to prioritize the sensing of such a change.

If the sensed concentration has not reached the predetermined value, the situation may be treated as one in which there is no concern related to an object to be protected 30 approaching the washing machine 1000. By contrast, if the sensed concentration has reached the predetermined value, a warning signal is outputted (step S201), and the door 20 and the washing tub 10 are switched to the safe mode (step S301).

Even if the concentration of the specific component sensed in step S111 has not reached the predetermined value, in order to determine the safety of the situation with greater certainty, the concentration of the specific component in the air outside the washing tub 10 may be detected (step S121). Further, it may be sensed whether the difference between the concentration of the specific component sensed inside the washing tub 10 and the concentration of the specific component sensed outside the washing tub 10 has reached a predetermined value (step S131).

Even in the absence of a particular problem being detected in steps S101 and S111, if the difference between the concentrations of the specific component sensed inside and outside the washing tub 10 exceeds a certain level, it can nonetheless be determined that an object to be protected 30 is present in the washing tub 10. Accordingly, if the difference between the concentration of the specific component sensed inside the washing tub 10 and the concentration of the specific component sensed outside the washing tub 10 reaches a predetermined value, a warning signal is outputted (step S201), and the door 20 and the washing tub 10 are switched to the safe mode (step S301).

As such, in the method for controlling a washing machine according to this embodiment, by switching the door 20 and the washing tub 10 to the safe mode in response to the difference between the concentration of the specific component sensed inside the washing tub 10 and the concentration of the specific component sensed outside the washing tub 10 reaching the predetermined value, the washing machine 1000 can be appropriately switched from the normal mode in which the washing machine 1000 can operate normally to the safe mode in which the operation of the machine 1000 is restricted.

With the exception of the above-described configuration and features of the method for controlling a washing machine according to this embodiment of the present disclosure, the method for controlling a washing machine according to this embodiment is the same as or similar to the method for controlling a washing machine according to the embodiment of the present disclosure described previously above. As such, detailed description of overlapping content is omitted.

While the foregoing has been given by way of illustrative example of the present disclosure, all such and other modifications and variations thereto as would be apparent to those skilled in the art are deemed to fall within the broad scope and ambit of this disclosure as is herein set forth. Accordingly, such modifications or variations are not to be regarded as a departure from the spirit or scope of the present disclosure, and it is intended that the present disclosure cover the modifications and variations of this disclosure provided they come within the scope of the appended claims and their equivalents.

The present disclosure is directed to addressing the shortcomings associated with washing machines in some related art discussed above. Specifically, the present disclosure is directed to preventing occurrence of accidents related to a child or pet being inside a washing tub, both by preventing the child or pet from entering a washing machine in advance and by inducing an immediate reaction from a child or pet that has entered the washing tub.

The present disclosure is further directed to, when operation of the washing machine has been restricted due to a concern that an accident may occur, providing a process to allow the restriction to be released based on reliable grounds, while also allowing such a process to take place easily from the perspective of the user. The present disclosure is still further directed to enabling effective detection of the presence of a child or pet in the washing tub even in situations in which such detection is difficult, and enabling appropriate response measures, considering various behavior patterns of the child or pet that has entered the washing tub, to be taken. The present disclosure is not limited to what has been described above, and other technical aspects not mentioned above will be clearly understood by those skilled in the art from the description.

A washing machine and control method thereof according to an aspect of the present disclosure are configured to identify a possibility of occurrence of an accident by sensing a concentration of a specific component in the air, and to control the washing machine accordingly. Specifically, the washing machine and control method thereof according to this aspect of the present disclosure are configured to output a warning signal and switch a door and a washing tub to a safe mode in response to a determination that there is a possibility of occurrence of an accident based on a sensed concentration of a specific component in the air measured inside or outside the washing tub.

In addition, the washing machine and control method thereof according to an aspect of the present disclosure are configured to switch the door and the washing tub, which have been switched to the safe mode, back to a normal mode, in response to detection of a release signal indicating that the risk of accident has been removed. Specifically, the washing machine and control method thereof according to this aspect of the present disclosure are configured to, after having switched the door and the washing tub to the safe mode due to the possibility of occurrence of an accident, switch the door and the washing tub back to the normal mode in response to a determination that there is no risk of accident based on detection of a release signal set in advance.

In addition, the washing machine and control method thereof according to an aspect of the present disclosure are configured to be capable of identifying the presence of a child or pet in the washing tub regardless of the behavior pattern of the child or pet in the washing tub. Specifically, the washing machine and control method thereof according to this aspect of the present disclosure are configured to identify the presence of a child or pet in the washing tub even when the child or pet does not make any sounds or movements in the washing tub, based on a concentration of a specific component being sensed in the air measured inside or outside the washing tub.

In addition, the washing machine and control method thereof according to an aspect of the present disclosure may sense the concentration of a specific component in the air both inside the washing tub and outside the washing tub. In addition, the washing machine and control method thereof according to an aspect of the present disclosure may sense the concentration of a specific component in the air in an air outlet that is formed in the washing tub so as to communicate with the air outside the washing tub.

In addition, the washing machine and control method thereof according to an aspect of the present disclosure may sense the concentration of at least one of oxygen or carbon dioxide. In addition, the washing machine and control method thereof according to an aspect of the present disclosure may switch the door and the washing tub to a safe mode in response to the concentration of the specific component sensed inside and/or outside the washing tub reaching a predetermined value.

In addition, the washing machine and control method thereof according to an aspect of the present disclosure may switch the door and the washing tub to a safe mode in response to the difference between the concentration of the specific component sensed inside the washing tub and the concentration of the specific component sensed outside the washing tub reaching a predetermined value.

In addition, in the safe mode of the washing machine and control method thereof according to an aspect of the present disclosure, the door may be switched to an unlock mode, and the washing tub may be switched to a lock mode. In addition, the washing machine and control method thereof according to an aspect of the present disclosure may output notification information according to the sensed concentration of the specific component by displaying the notification information.

In addition, the washing machine and control method thereof according to an aspect of the present disclosure may remotely transmit the notification information according to the sensed concentration of the specific component. Aspects that can be achieved by the present disclosure are not limited what has been disclosed hereinabove, and other aspects can be clearly understood from the following description by those skilled in the art to which the present disclosure pertains.

According to the washing machine and control method thereof of the present disclosure, the following aspects can be achieved. According to at least one of the various embodiments of the present disclosure, by outputting a warning signal and switching the door and the washing tub to a safe mode in response to a determination of a possibility of occurrence of an accident based on a sensed concentration of a specific component in the air measured inside or outside the washing tub, occurrence of an accident relating to a child or pet being inside the washing tub can be effectively prevented.

In addition, according to at least one of the various embodiments of the present disclosure, by switching the door and the washing tub back to a normal mode in response to a determination that there is no risk of accident based on detection of a release signal set in advance, the washing machine can return to normal functioning based on reliable grounds, while also allowing such a process to take place easily from the perspective of the user.

In addition, according to at least one of the various embodiments of the present disclosure, by identifying the presence of a child or pet in the washing tub even when the child or pet does not make any sounds or movements, based on a concentration of a specific component in the air measured inside or outside the washing tub, the presence of a child or pet in the washing tub can be effectively detected even in situations in which such detection is difficult.

In addition, according to at least one of the various embodiments of the present disclosure, by sensing the concentration of a specific component in the air both inside the washing tub and outside the washing tub, the possibility of occurrence of accidents can be identified according to various different situations in a variety of different ways.

In addition, according to at least one of the various embodiments of the present disclosure, by sensing the concentration of a specific component in the air in an air outlet that is formed in the washing tub so as to communicate with the air outside the washing tub, a sensor can be installed at a position with good air flow and at which stable installation is possible, thereby improving sensing performance. In addition, according to at least one of the various embodiments of the present disclosure, by sensing the concentration of at least one of oxygen or carbon dioxide, appropriate measures can be provided to prevent the potential occurrence of suffocation or asphyxiation accidents involving a child or pet in the washing tub.

In addition, according to at least one of the various embodiments of the present disclosure, by switching the door and the washing tub to a safe mode in response to the concentration of the specific component sensed inside and/or outside the washing tub reaching a predetermined value, the washing machine can be appropriately switched from a normal mode in which the washing machine can operate normally to a safe mode in which the operation of the machine is restricted.

In addition, according to at least one of the various embodiments of the present disclosure, by switching the door and the washing tub to a safe mode in response to the difference between the concentration of the specific component sensed inside the washing tub and the concentration of the specific component sensed outside the washing tub reaching a predetermined value, the washing machine can be appropriately switched from a normal mode in which the washing machine can operate normally to a safe mode in which the operation of the machine is restricted.

In addition, according to at least one of the various embodiments of the present disclosure, since in the safe mode the door may be switched to an unlock mode and the washing tub may be switched to a lock mode, occurrence of accidents due to a lack of oxygen in the washing tub or due to operation of the washing machine can be prevented even when a child or pet has entered the washing tub. In addition, according to at least one of the various embodiments of the present disclosure, by outputting notification information according to the sensed concentration of the specific component by displaying the notification information, a user can easily identify the state of the washing machine in relation to a potential accident.

In addition, according to at least one of the various embodiments of the present disclosure, by remotely transmitting the notification information according to the sensed concentration of the specific component to a user, the user can identify the state of the washing machine relatively quickly and easily even when he or she is at a distance from the washing machine.

Further scope of applicability of the present disclosure will be apparent from the above detailed description. It should be understood, however, that specific examples, such as the detailed description and the preferred embodiments of the present disclosure, are given by way of illustration only, since various changes and modifications within the spirit and scope of the present disclosure will become apparent to those skilled in the art.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A laundry treatment device comprising:

a tub configured to be opened and closed by a door;

a sensor configured to measure a concentration of a component in at least one of air inside the tub or air outside the tub;

a controller configured to switch the laundry treatment device to a safe mode based on the concentration of the component measured by the sensor, an operation of at least one of the door or the tub being limited during the safe mode; and a release signal detector configured to detect a predetermined release signal, wherein the controller switches the laundry treatment device back from the safe mode based on the release signal detector detecting the predetermined release signal, wherein the release signal detector includes at least one of a camera or a microphone configured to identify a registered user such that the predetermined release signal is automatically detected by the camera or the microphone when the registered user approaches the laundry treatment device, and wherein the predetermined release signal is registered in advance with a face information of the registered user authorized to operate the laundry treatment device via the camera or a voice information of the registered user authorized to operate the laundry treatment device via the microphone.

2. The laundry treatment device of claim 1, further comprising an output device configured to output a warning based on the concentration of the component measured by the sensor.

3. The laundry treatment device of claim 1, wherein the sensor includes:

at least one internal sensor configured to measure a first concentration of the component in air inside the tub; and at least one external sensor configured to measure a second concentration of the component in air outside the tub.

4. The laundry treatment device of claim 3, wherein the tub includes an air outlet formed so as to communicate outside the tub, and wherein the at least one internal sensor is positioned to measure air in the air outlet.

5. The laundry treatment device of claim 3, wherein the at least one external sensor is provided at a surface of the laundry treatment device where the door is positioned.

6. The laundry treatment device of claim 1, wherein the sensor is configured to sense respective concentrations of at least one of oxygen, water vapor, or carbon dioxide.

7. The laundry treatment device of claim 1, further comprising a display configured to output notification information according to the concentration of the component sensed by the sensor.

8. The laundry treatment device of claim 7, further comprising a transmitter configured to remotely transmit the notification information according to the concentration of the component sensed by the sensor.

* * * * *